US008858281B2

(12) United States Patent
Kuriyagawa et al.

(10) Patent No.: US 8,858,281 B2
(45) Date of Patent: Oct. 14, 2014

(54) OUTBOARD MOTOR CONTROL APPARATUS

(75) Inventors: Koji Kuriyagawa, Wako (JP); Hajime Yoshimura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 262 days.

(21) Appl. No.: 12/967,220

(22) Filed: Dec. 14, 2010

(65) Prior Publication Data

US 2011/0143610 A1 Jun. 16, 2011

(30) Foreign Application Priority Data

Dec. 16, 2009 (JP) ..... 2009-285802
Dec. 16, 2009 (JP) ..... 2009-285803
Dec. 16, 2009 (JP) ..... 2009-285805

(51) Int. Cl.
*B60W 10/10* (2012.01)
*B60W 10/06* (2006.01)
*B63H 21/21* (2006.01)
*B63H 21/22* (2006.01)

(52) U.S. Cl.
CPC ..... *B63H 21/22* (2013.01)
USPC ..... 440/86; 440/1; 701/21; 701/87

(58) Field of Classification Search
CPC ..... B60K 28/16; B60K 28/165
USPC ..... 440/1, 84, 86; 701/21, 86, 87
See application file for complete search history.

(56) References Cited

U.S. PATENT DOCUMENTS 5,190,487 A 3/1993 Fukui
6,478,715 B1 11/2002 Hunold
6,659,815 B2 * 12/2003 Motsenbocker ..... 440/1
6,669,599 B2 * 12/2003 Iwase et al. ..... 477/97
7,762,859 B2 7/2010 Suzuki et al.
7,892,052 B2 2/2011 Suzuki et al.
7,957,880 B2 * 6/2011 Watabe et al. ..... 701/90
8,016,626 B2 * 9/2011 Suzuki et al. ..... 440/75
8,162,708 B2 4/2012 Suzuki et al.
2009/0209151 A1 8/2009 Suzuki et al.

FOREIGN PATENT DOCUMENTS

JP 4-159195 A 6/1992
JP 4-325734 A 11/1992
JP 4-325741 A 11/1992
JP 5-105191 A 4/1993
JP 10-329586 A 12/1998
JP 2002-524341 A 8/2002
JP 2009-190671 A 8/2009
JP 2009-190673 A 8/2009
JP 2009-196515 A 9/2009
JP 2009-202686 A 9/2009

* cited by examiner

*Primary Examiner* — Lars A Olson
*Assistant Examiner* — Andrew Polay
(74) *Attorney, Agent, or Firm* — Carrier Blackman & Associates, P.C.; William D. Blackman; Jeffrey T. Gedeon

(57) ABSTRACT

In an apparatus for controlling operation of an outboard motor having an internal combustion engine to power a propeller, and a transmission being selectively changeable in gear position to establish speeds including a first speed and a second speed and transmitting power of the engine to the propeller with a gear ratio determined by established speed, it is determined whether acceleration is instructed to the engine when the second speed is established and whether a preset condition is met, and operation of the transmission is controlled to change the gear position from the second speed to the first speed when the acceleration is determined to be instructed and the preset condition is met, thereby improving the acceleration performance of immediately after the acceleration is started.

16 Claims, 12 Drawing Sheets

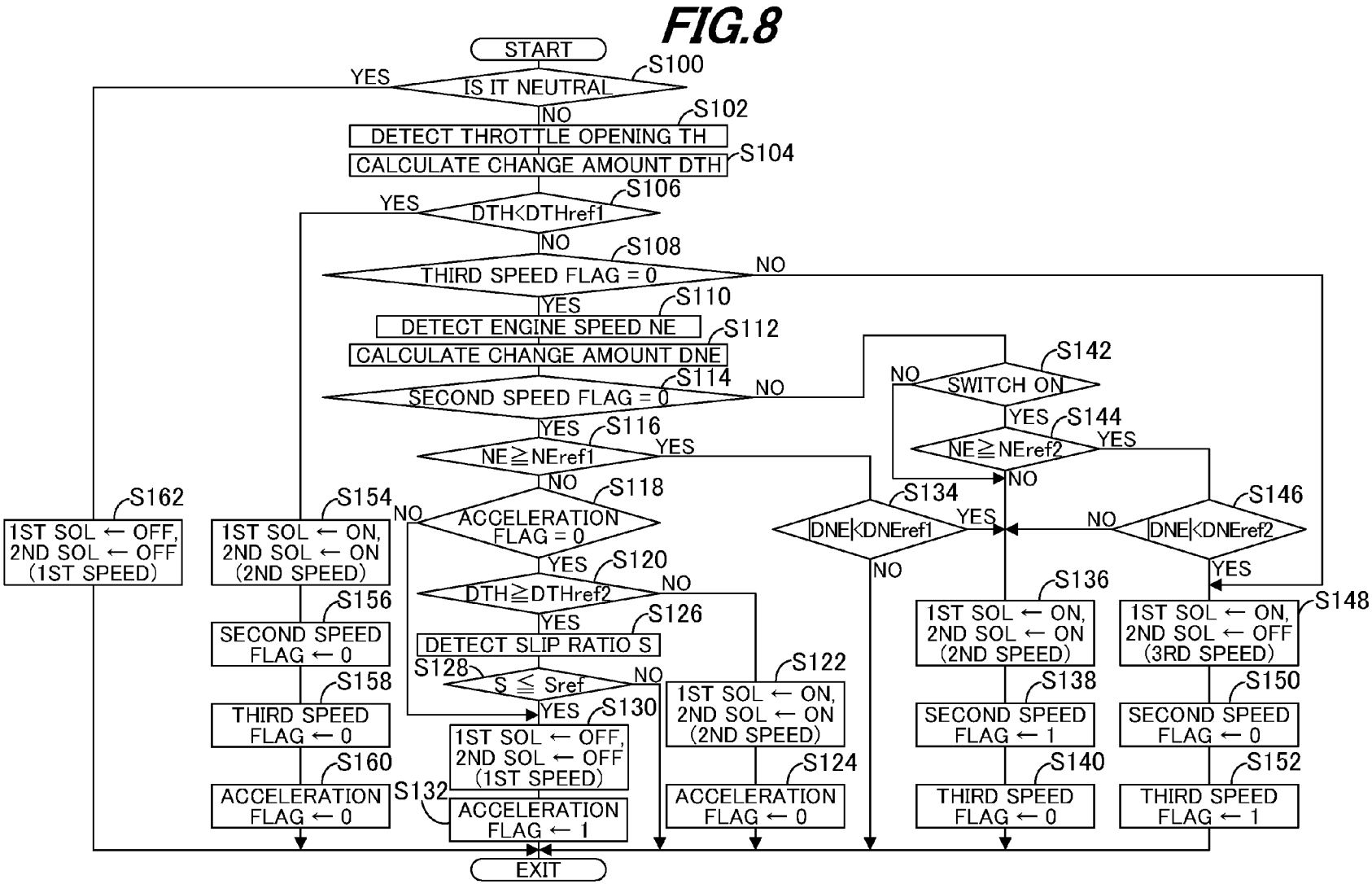
FIG.8
START
S100
IS IT NEUTRAL
YES
NO
S102
DETECT THROTTLE OPENING TH
S104
CALCULATE CHANGE AMOUNT DTH
S106
DTH<DTHref1
S108
THIRD SPEED FLAG = 0
S110
S112
DETECT ENGINE SPEED NE
CALCULATE CHANGE AMOUNT DNE
S114
SECOND SPEED FLAG = 0
S116
NE≧NEref1
S118
ACCELERATION FLAG = 0
S120
DTH≧DTHref2
S126
DETECT SLIP RATIO S
S128
S≦Sref
S130
1ST SOL ← OFF, 2ND SOL ← OFF (1ST SPEED)
S132
ACCELERATION FLAG ← 1
S122
1ST SOL ← ON, 2ND SOL ← ON (2ND SPEED)
S124
ACCELERATION FLAG ← 0
S134
DNE<DNEref1
S142
SWITCH ON
S144
NE≧NEref2
S146
DNE<DNEref2
S148
1ST SOL ← ON, 2ND SOL ← OFF (3RD SPEED)
S150
SECOND SPEED FLAG ← 0
S152
THIRD SPEED FLAG ← 1
S136
1ST SOL ← ON, 2ND SOL ← ON (2ND SPEED)
S138
SECOND SPEED FLAG ← 1
S140
THIRD SPEED FLAG ← 0
S154
1ST SOL ← ON, 2ND SOL ← ON (2ND SPEED)
S156
SECOND SPEED FLAG ← 0
S158
THIRD SPEED FLAG ← 0
S160
ACCELERATION FLAG ← 0
S162
1ST SOL ← OFF, 2ND SOL ← OFF (1ST SPEED)
EXIT

OUTBOARD MOTOR CONTROL APPARATUS

BACKGROUND OF THE INVENTION

1. Field of the Invention

This invention relates to an outboard motor control apparatus, particularly to an apparatus for controlling an outboard motor with a transmission.

2. Description of the Related Art

In recent years, there is proposed an outboard motor equipped with a transmission, which has gear position to establish the first speed and second speed, interposed at a location between an internal combustion engine and a propeller shaft to change output of the engine in speed and then transmit it to the propeller shaft, as taught, for example, by Japanese Laid-Open Patent Application No. 2009-190671.

SUMMARY OF THE INVENTION

In the reference, when a throttle lever is manipulated by the operator to accelerate the boat, the gear position (gear ratio) of the transmission is changed from the second speed to the first speed to amplify torque to be transmitted to the propeller shaft, thereby improving the acceleration performance.

However, immediately after the acceleration is started upon the manipulation of the throttle lever, a propeller tends to be rotated idly because it draws in air bubbles generated around a hull, whereby a grip force of the propeller becomes relatively small. If the second speed is changed to the first speed under this condition, it may rather decrease thrust of the boat disadvantageously. Thus it still leaves room for improvement.

An object of this invention is therefore to overcome the foregoing drawbacks by providing an apparatus for controlling an outboard motor having a transmission, which apparatus can appropriately control the operation of the transmission, thereby improving the performance of immediately after the acceleration is started.

In order to achieve the object, this invention provides in a first aspect an apparatus for controlling operation of an outboard motor adapted to be mounted on a stern of a boat and having an internal combustion engine to power a propeller through a propeller shaft, and a transmission installed at a location between the engine and the propeller shaft, the transmission being selectively changeable in gear position to establish speeds including at least a first speed and a second speed and transmitting power of the engine to the propeller with a gear ratio determined by established speed, comprising: an acceleration instruction determiner that determines whether acceleration is instructed to the engine when the second speed is established; a preset-condition determiner that determines whether a preset condition is met; and a transmission controller that controls operation of the transmission to change the gear position from the second speed to the first speed when the acceleration is determined to be instructed and the preset condition is met.

In order to achieve the object, this invention provides in a second aspect a method for controlling operation of an outboard motor adapted to be mounted on a stern of a boat and having an internal combustion engine to power a propeller through a propeller shaft, and a transmission installed at a location between the engine and the propeller shaft, the transmission being selectively changeable in gear position to establish speeds including at least a first speed and a second speed and transmitting power of the engine to the propeller with a gear ratio determined by established speed, comprising the steps of: determining whether acceleration is instructed to the engine when the second speed is established; determining whether a preset condition is met; and controlling operation of the transmission to change the gear position from the second speed to the first speed when the acceleration is determined to be instructed and the preset condition is met.

BRIEF DESCRIPTION OF THE DRAWINGS

The above and other objects and advantages of the invention will be more apparent from the following description and drawings in which:

FIG. 8 is a flowchart similar to FIG. 5, but showing transmission control operation by an electronic control unit of an outboard motor control apparatus according to a second embodiment of the invention;

DETAILED DESCRIPTION OF THE PREFERRED EMBODIMENTS

Preferred embodiments of an outboard motor control apparatus according to the invention will now be explained with reference to the attached drawings.

Figure 1:
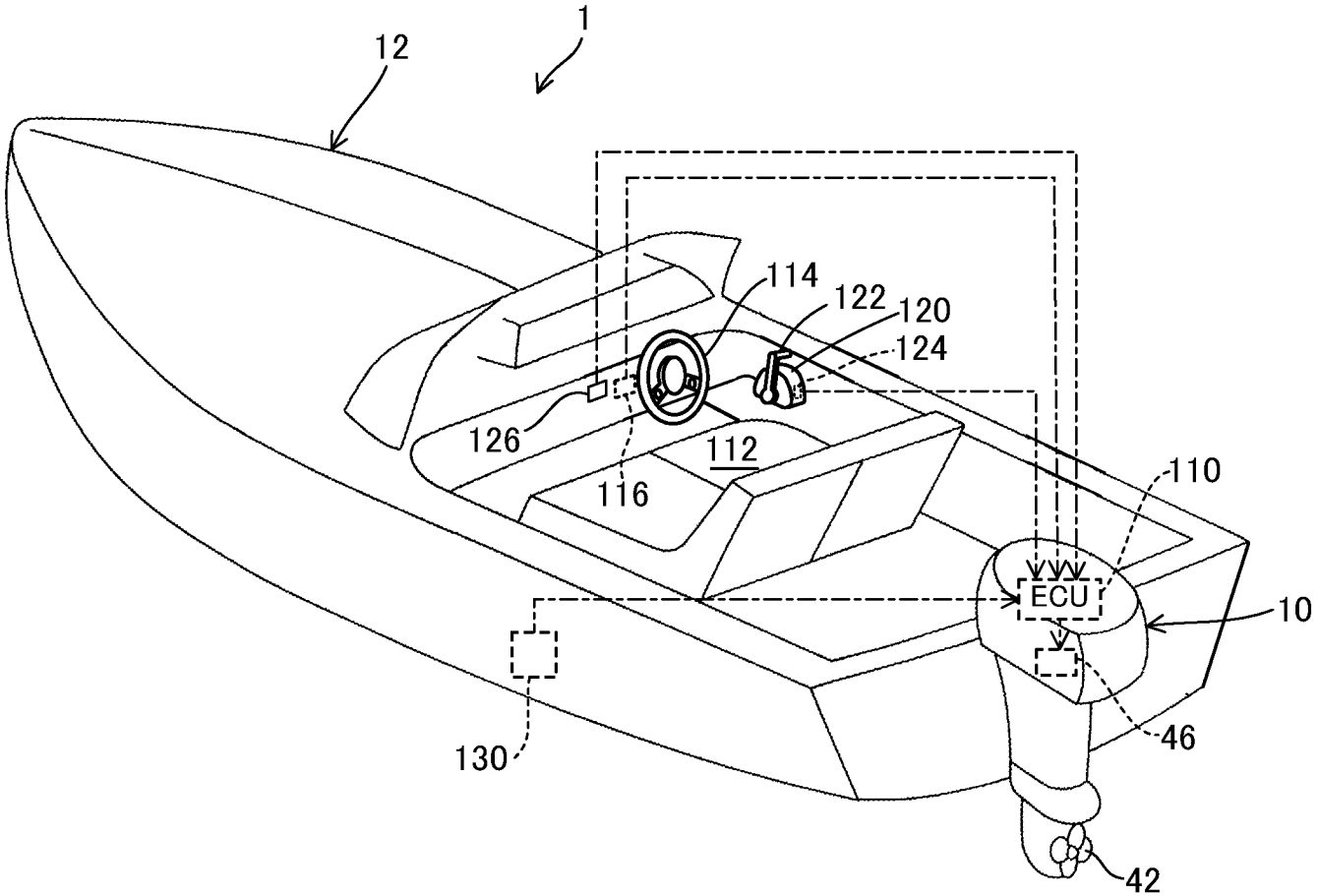
FIG. 1 is an overall schematic view of an outboard motor control apparatus including a boat according to a first embodiment of the invention.
Figure 2:
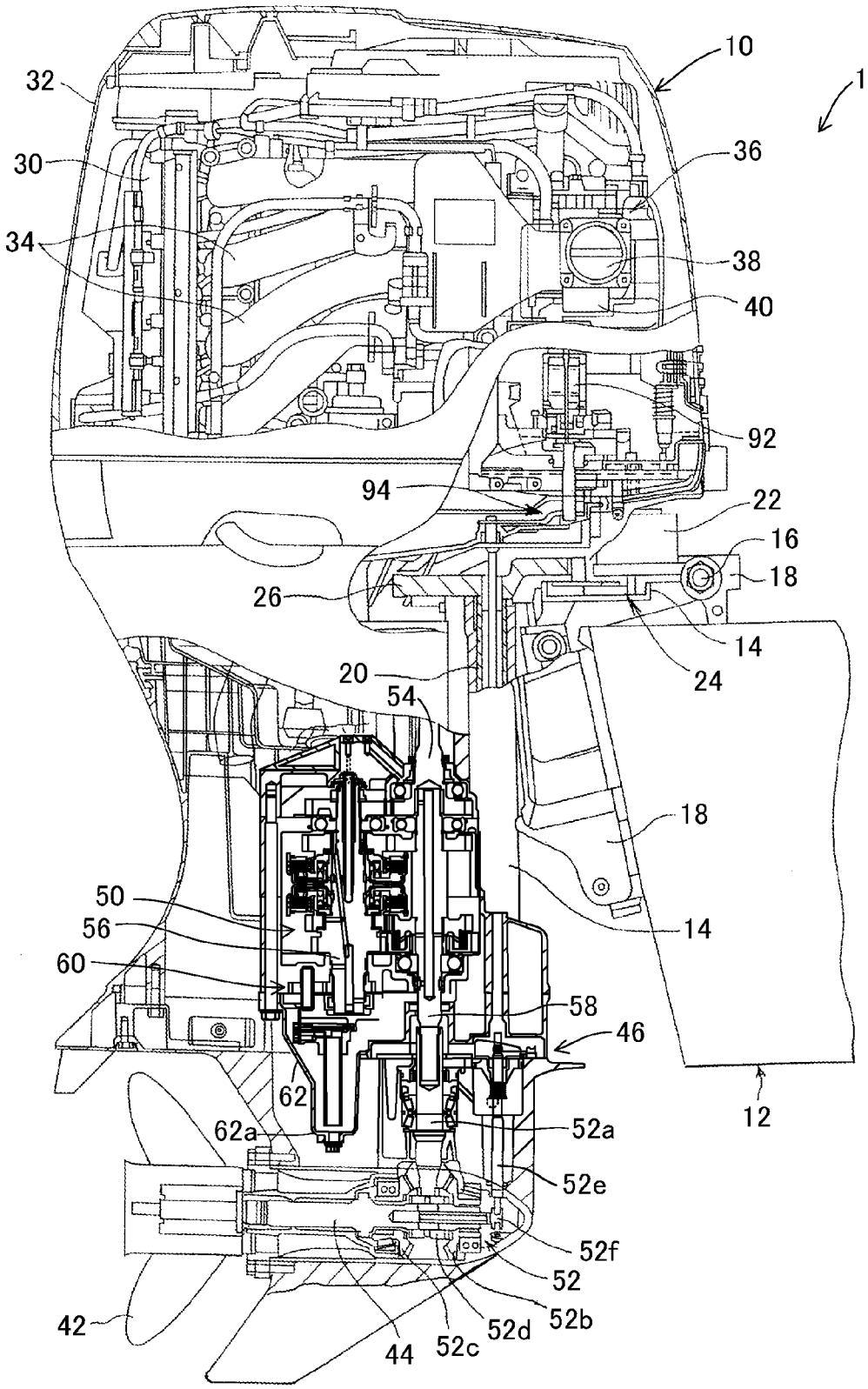
FIG. 2 is an enlarged sectional side view partially showing the outboard motor shown in FIG. 1.

FIG. 1 is an overall schematic view of an outboard motor control apparatus including a boat according to a first embodiment of the invention. FIG. 2 is an enlarged sectional side view partially showing the outboard motor shown in FIG. 1 and FIG. 3 is an enlarged side view of the outboard motor.

Figure 3:
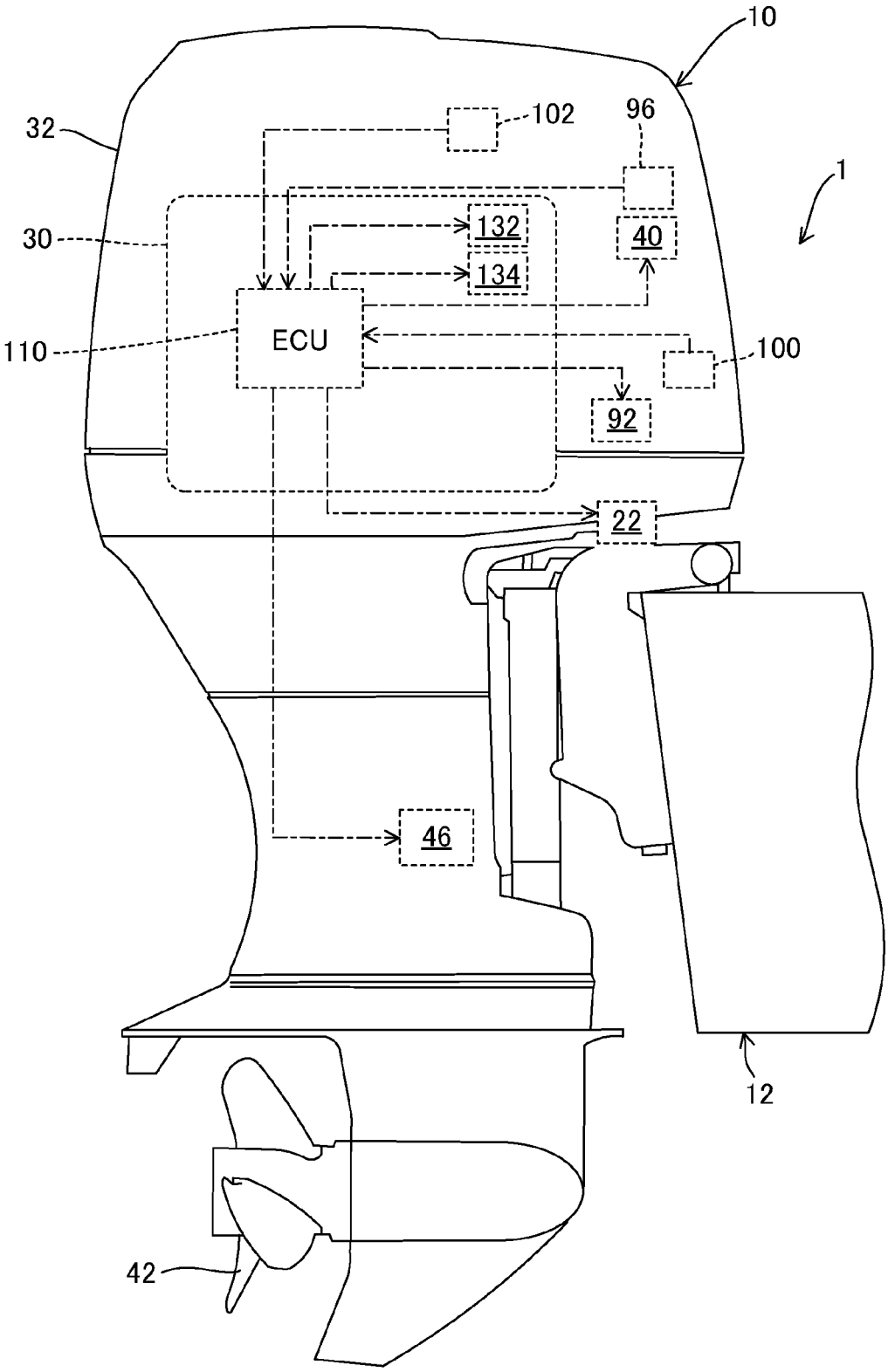
FIG. 3 is an enlarged side view of the outboard motor shown in FIG. 1.

In FIGS. 1 to 3, a symbol 1 indicates a boat or vessel whose hull 12 is mounted with an outboard motor 10. As clearly shown in FIG. 2, the outboard motor 10 is clamped (fastened) to the stern or transom of the boat 1, more precisely to the stern of the hull 12 through a swivel case 14, tilting shaft 16 and stern brackets 18.

An electric steering motor (actuator) 22 for operating a shaft 20 which is housed in the swivel case 14 to be rotatable about the vertical axis is installed above the swivel case 14. A rotational output of the steering motor 22 is transmitted to the shaft 20 via a speed reduction gear mechanism 24 and a mount frame 26, whereby the outboard motor 10 is steered about the shaft 20 as a steering axis to the right and left directions (steered about the vertical axis).

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An air intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30 to control engine speed NE of the engine 30.

The outboard motor 10 further comprises a propeller shaft (power transmission shaft) 44 that is supported to be rotatable about the horizontal axis and attached with a propeller 42 at its one end to transmit power output of the engine 30 thereto, and a transmission (automatic transmission) 46 that is interposed at a location between the engine 30 and propeller shaft 44 and has a plurality of gear positions, i.e., first, second and third speeds.

The transmission 46 comprises a transmission mechanism 50 that can selectively change the gear position to establish speeds including the first to third speeds, and a shift mechanism 52 that can change a shift position among forward, reverse and neutral positions.

Figure 4:
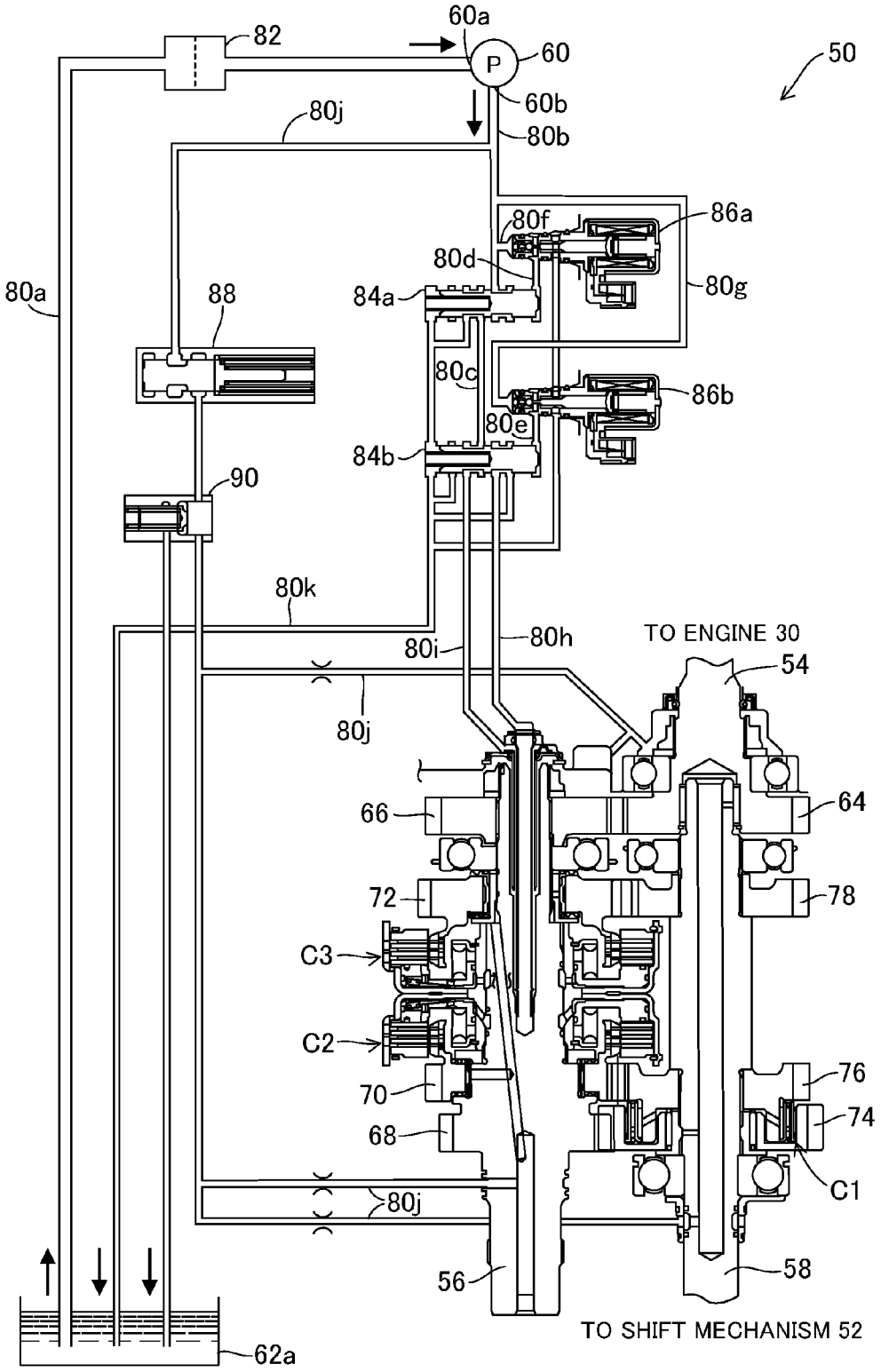
FIG. 4 is a hydraulic circuit diagram schematically showing a hydraulic circuit of a transmission mechanism shown in FIG. 2.

FIG. 4 is a hydraulic circuit diagram schematically showing a hydraulic circuit of the transmission mechanism 50.

As shown in FIGS. 2 and 4, the transmission mechanism 50 comprises a parallel-axis type transmission mechanism with distinct gear positions (gear ratios), which includes an input shaft 54 connected to the crankshaft (not shown in the figures) of the engine 30, a countershaft 56 connected to the input shaft 54 through a gear, and an output shaft 58 connected to the countershaft 56 through several gears. Those shafts 54, 56, 58 are installed in parallel.

The countershaft 56 is connected with a hydraulic pump (gear pump; shown in FIGS. 2 and 4) 60 that pumps up the operating oil (lubricating oil) and forwards it to transmission clutches and lubricated portions of the transmission mechanism 50 (explained later). The foregoing shafts 54, 56, 58, hydraulic pump 60 and the like are housed in a case 62 (shown only in FIG. 2). An oil pan 62*a* for receiving the operating oil is formed at the bottom of the case 62.

In the so-configured transmission mechanism 50, the gear installed on the shaft to be rotatable relative thereto is fixed on the shaft through the transmission clutch so that the gear position to establish the three speeds (i.e., first to third speeds) is established (selected), and the output of the engine 30 is changed with the established (selected) gear position and transmitted to the propeller 42 through the shift mechanism 52 and propeller shaft 44. A gear ratio (speed reduction ratio) determined by the gear position is set to be the highest in the first speed and decreases as the gear position changes to second and then third speed. Specifically, for instance, the first speed gear ratio is 2.2, the second speed gear ratio 2.0, and the third speed gear ratio 1.7.

The further explanation on the transmission mechanism 50 will be made. As clearly shown in FIG. 4, the input shaft 54 is supported with an input primary gear 64. The countershaft 56 is supported with a counter primary gear 66 to be meshed with the input primary gear 64, and also with a counter first-speed gear 68, counter second-speed gear 70 and counter third-speed gear 72.

The output shaft 58 is supported with an output first-speed gear 74 to be meshed with the counter first-speed gear 68, an output second-speed gear 76 to be meshed with the counter second-speed gear 70, and an output third-speed gear 78 to be meshed with the counter third-speed gear 72.

In the above configuration, when the output first-speed gear 74 supported to be rotatable relative to the output shaft 58 is brought into a connection with the output shaft 58 through a first-speed clutch C1, the first speed (gear; gear position) is established. The first-speed clutch C1 comprises a one-way clutch. When a second-speed or third-speed hydraulic clutch C2 or C3 (explained later) is supplied with hydraulic pressure so that the second or third speed is established and the rotational speed of the output shaft 58 becomes greater than that of the output first-speed gear 74, the first-speed clutch C1 makes the output first-speed gear 74 rotate idly (i.e., rotate without being meshed).

When the counter second-speed gear 70 supported to be rotatable relative to the countershaft 56 is brought into a connection with the countershaft 56 through the second-speed hydraulic clutch C2, the second speed (gear; gear position) is established. Further, when the counter third-speed gear 72 supported to be rotatable relative to the countershaft 56 is brought into a connection with the countershaft 56 through the third-speed hydraulic clutch C3, the third speed (gear; gear position) is established. The hydraulic clutches C2, C3 connect the gears 70, 72 to the countershaft 56 upon being supplied with the operating oil, while making the gears 70, 72 rotate idly when the operating oil is not supplied.

The interconnections between the gears and shafts through the clutches C1, C2, C3 are performed by controlling hydraulic pressure supplied from the pump 60 to the hydraulic clutches C2, C3.

The further explanation will be made with reference to FIG. 4. An intake port 60*a* of the pump 60 is connected to the oil pan 62*a* through an oil passage 80*a*. The oil passage 80*a* is interposed with a strainer 82.

A discharge port 60*b* of the pump 60 is connected to a first switching valve 84*a* through an oil passage 80*b* and the first switching valve 84*a* is connected to a second switching valve 84*b* through an oil passage 80*c*. Each of the valves 84*a*, 84*b* has a movable spool installed therein. The spool is urged by a spring at its one end (left end in the drawing) toward the other end.

The first and second switching valves 84*a*, 84*b* are connected on the sides of the other ends of the spools with first and second electromagnetic solenoid valves (linear solenoid valves) 86*a*, 86*b* through oil passages 80*d*, 80*e*, respectively. The solenoid valves 86*a*, 86*b* are interposed at oil passages 80*f*, 80*g* which are branched from the oil passage 80*b*.

The second switching valve 84*b* is connected to the second-speed hydraulic clutch C2 through an oil passage 80*h*, while being connected to the third-speed hydraulic clutch C3 through an oil passage 80*i*.

The discharge port 60*b* is also connected to the lubricated portions (e.g., the shafts 54, 56, 58, etc.) of the transmission 46 through the oil passage 80*b* and an oil passage 80*j* branched therefrom. The oil passage 80*j* is interposed with a regulator valve 88 that regulates hydraulic pressure to be supplied to the lubricated portions, and a relief valve 90 that, when the hydraulic pressure of the operating oil regulated by the regulator valve 88 becomes equal to or greater than prescribed pressure, returns the operating oil to the oil pan 62*a*.

The first and second switching valves 84*a*, 84*b* and the first and second solenoid valves 86*a*, 86*b* are connected with an oil passage 80*k* adapted to relieve pressure and an end of the oil passage 80*k* is open at the oil pan 62*a*.

As configured above, the pump 60 driven by the engine 30 (more exactly, the countershaft 56 of the transmission 46 transmitted with the output of the engine 30) pumps up the operating oil in the oil pan 62*a* through the oil passage 80*a* and strainer 82 and forwards it from the discharge port 60*b* to the first switching valve 84*a* and the first and second solenoid valves 86*a*, 86*b* through the oil passage 80*b* and the like. The pump 60 also supplies the operating oil (lubricating oil) to the lubricated portions of the transmission 46 through the oil passage 80*j*, regulator valve 88 and relief vale 90.

Upon being supplied with current (i.e., made ON), a spool housed in the first solenoid valve 86*a* is displaced to output the hydraulic pressure supplied from the pump 60 to the other end side of the spool of the first switching valve 84*a*. The spool of the first switching valve 84*a* is displaced in response to the hydraulic pressure outputted to its other end side, thereby forwarding the operating oil in the oil passage 80*b* to the oil passage 80*c*.

Similarly to the first solenoid valve 86*a*, upon being supplied with current (i.e., made ON), a spool of the second solenoid valve 86*b* is displaced to output the hydraulic pressure supplied from the pump 60 to the other end side of the spool of the second switching valve 84*b*.

When the second solenoid valve 86*b* is made ON and the hydraulic pressure is outputted to the other end side of the spool of the second switching valve 84*b* so that the spool is displaced, the operating oil in the oil passage 80*c* is forwarded to the second-speed hydraulic clutch C2 through the oil passage 80*h*. In contrast, when the second solenoid valve 86*b* is not supplied with current (made OFF) and the hydraulic pressure is not outputted to the other end side, the second switching valve 84*b* forwards the operating oil in the oil passage 80*c* to the third-speed hydraulic clutch C3 through the oil passage 80*i*.

Consequently, when the first and second solenoid valves 86*a*, 86*b* are both made OFF, the hydraulic pressure is not supplied to the hydraulic clutches C2, C3 and hence, the output first-speed gear 74 and output shaft 58 are interconnected through the first-speed clutch C1 so that the first speed is established.

When the first and second solenoid valves 86*a*, 86*b* are both made ON, the hydraulic pressure is supplied to the second-speed hydraulic clutch C2 and accordingly, the counter second-speed gear 70 and countershaft 56 are interconnected so that the second speed is established. As mentioned in the foregoing, when the second speed is established and the rotational speed of the output shaft 58 exceeds that of the output first-speed gear 74, the gear 74 is disconnected from the shaft 58 by the first-speed clutch C1 and therefore rotated idly.

Further, when the first solenoid valve 86*a* is made ON and the second solenoid valve 86*b* is made OFF, the hydraulic pressure is supplied to the third-speed hydraulic clutch C3 and accordingly, the counter third-speed gear 72 and countershaft 56 are interconnected so that the third speed is established. As in the case of the second speed, the output first-speed gear 74 is rotated idly. Thus, one of the gear positions of the transmission 46 is selected (i.e., transmission control is conducted) by controlling ON/OFF of the first and second switching valves 84*a*, 84*b*.

The explanation on FIG. 2 is resumed. The shift mechanism 52 comprises a drive shaft (vertical shaft) 52*a* that is connected to the output shaft 58 of the transmission mechanism 50 and installed parallel to the vertical axis to be rotatably supported, a forward bevel gear 52*b* and reverse bevel gear 52*c* that are connected to the drive shaft 52*a* to be rotated, a clutch 52*d* that can engage the propeller shaft 44 with either one of the forward bevel gear 52*b* and reverse bevel gear 52*c*, and other components.

The interior of the engine cover 32 is disposed with an electric shift motor (actuator) 92 that drives the shift mechanism 52. The output shaft of the shift motor 92 can be connected via a speed reduction gear mechanism 94 with the upper end of a shift rod 52*e* of the shift mechanism 52. When the shift motor 92 is operated, its output appropriately displaces the shift rod 52*e* and a shift slider 52*f* to move the clutch 52*d* to change the shift position among the forward, reverse and neutral positions.

When the shift position is forward or reverse, the rotational output of the output shaft 58 is transmitted via the shift mechanism 52 to the propeller shaft 44 to rotate the propeller 42 in one of the directions making the boat 1 move forward or rearward. The outboard motor 10 is equipped with a power source (not shown) such as a battery or the like attached to the engine 30 to supply operating power to the motors 22, 40, 92, etc.

As shown in FIG. 3, a throttle opening sensor (throttle opening change amount detector) 96 is installed near the throttle valve 38 and produces an output or signal indicative of opening of the throttle valve 38, i.e., throttle opening TH.

A neutral switch 100 is installed near the shift rod 52*e* and produces an ON signal when the shift position of the transmission 46 is neutral and an OFF signal when it is forward or reverse. A crank angle sensor 102 is installed near the crankshaft of the engine 30 and produces a pulse signal at every predetermined crank angle.

The outputs of the foregoing sensors and switch are sent to an Electronic Control Unit (ECU) 110 disposed in the outboard motor 10. The ECU 110 which has a microcomputer comprising a CPU, ROM, RAM and other devices is installed in the engine cover 32 of the outboard motor 10.

As shown in FIG. 1, a steering wheel 114 is installed near a cockpit (the operator's seat) 112 of the hull 12 to be manipulated or rotated by the operator (not shown). A steering angle sensor 116 attached on a shaft (not shown) of the steering wheel 114 produces an output or signal corresponding to the steering angle applied or inputted by the operator through the steering wheel 114.

A remote control box 120 provided near the cockpit 112 is equipped with a shift/throttle lever (throttle lever) 122 installed to be manipulated by the operator. The lever 122 can be moved or swung in the front-back direction from the initial position and is used by the operator to input a forward/reverse change command and an engine speed regulation command including an acceleration/deceleration command (or instruction) for the engine 30. A lever position sensor 124 is installed in the remote control box 120 and produces an output or signal corresponding to a position of the lever 122.

A switch 126 is also provided near the cockpit 112 to be manually operated by the operator to input a fuel consumption decreasing command for decreasing fuel consumption of the engine 30. The switch 126 is manipulated or pressed when the operator desires to travel the boat 1 with high fuel efficiency, and upon the manipulation, it produces a signal (ON signal) indicative of the fuel consumption decreasing command.

A boat speed sensor (speedometer for water; slip ratio detector) 130 is installed at an appropriate position of the hull 12 and produces an output or signal corresponding to speed or velocity (boat speed; hereinafter sometimes called the "actual velocity") V of the boat 1. The outputs of the sensors 116, 124, 130 and switch 126 are also sent to the ECU 110.

Based on the inputted outputs, the ECU 110 controls the operation of the motors 22, 40, 92 and performs the transmission control of the transmission 46. Further, based on the inputted outputs, the ECU 110 determines a fuel injection amount and ignition timing of the engine 30 to supply fuel by the determined injection amount from an injector 132 (shown in FIG. 3) and ignite air-fuel mixture, which is composed of injected fuel and sucked air, at the determined ignition timing through an ignition device 134.

Thus, the outboard motor control apparatus according to the embodiments is a Drive-By-Wire type apparatus whose operation system (steering wheel 14, lever 122) has no mechanical connection with the outboard motor 10.

Figure 5:
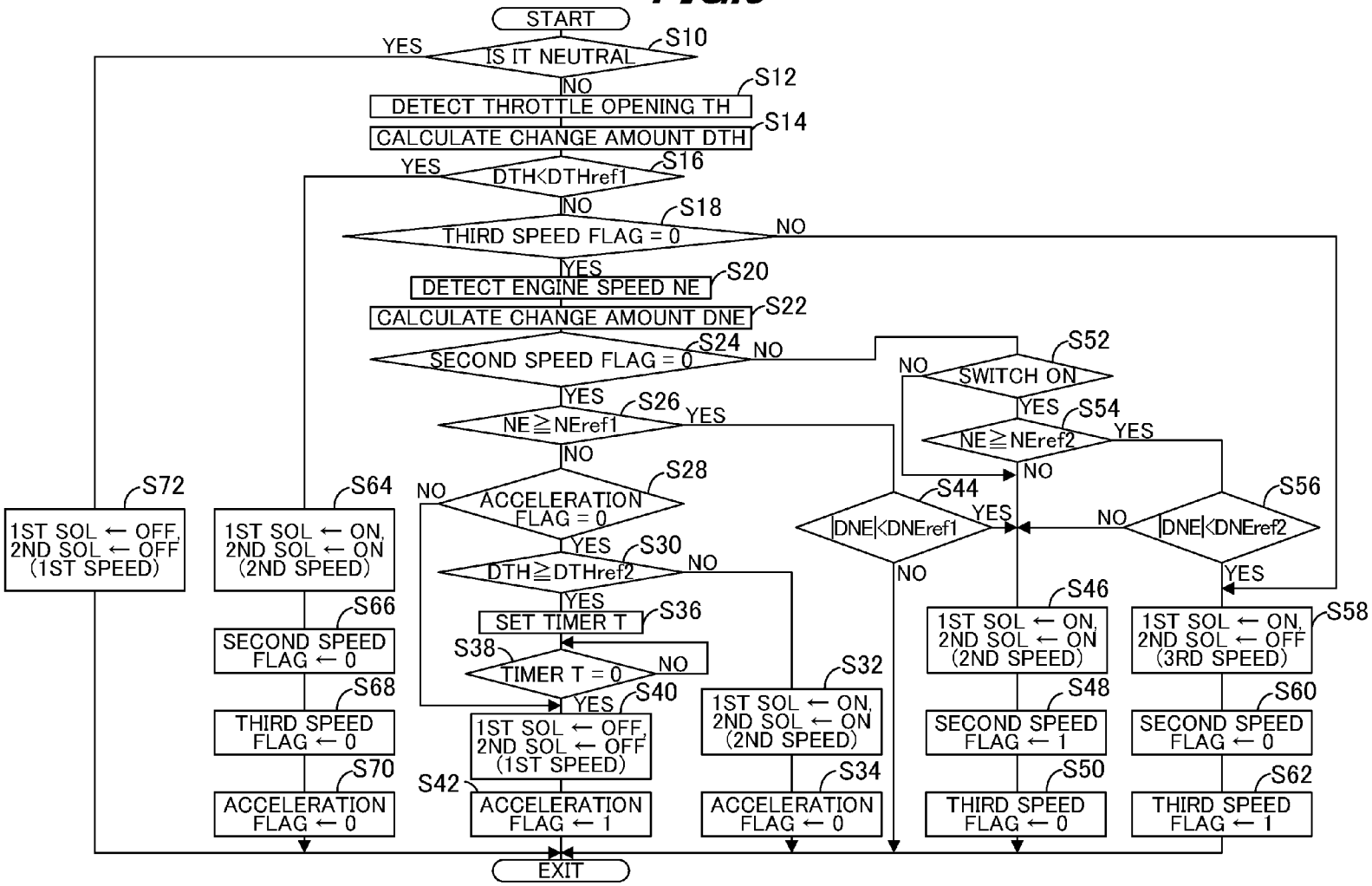
FIG. 5 is a flowchart showing transmission control operation by an electronic control unit shown in FIG. 1.

FIG. 5 is a flowchart showing the transmission control operation by the ECU 110. The illustrated program is executed by the ECU 110 at predetermined intervals, e.g., 100 milliseconds.

The program begins at S 10, in which it is determined whether the shift position of the transmission 46 is neutral. This determination is made by checking as to whether the neutral switch 100 outputs the ON signal. When the result in S10 is negative, i.e., it is determined to be in gear, the program proceeds to S12, in which the throttle opening TH is detected or calculated from the output of the throttle opening sensor 96, and to S14, in which a change amount (variation) DTH of the detected throttle opening TH per unit time (e.g., 500 milliseconds) is detected or calculated.

The program proceeds to S16, in which it is determined whether the deceleration is instructed to the engine 30 by the operator, i.e., whether the engine 30 is in the operating condition to decelerate the boat 1. This determination is made by checking as to whether the throttle valve 38 is operated in the closing direction, i.e., whether the change amount DTH is less than a first predetermined value DTHref1 (e.g., −0.5 degree).

Specifically, when the change amount DTH is less than the first predetermined value DTHref1 set to a negative value, the throttle valve 38 is determined to be operated in the closing direction (i.e., the deceleration is instructed to the engine 30) and when the change amount DTH is equal to or greater than the first predetermined value DTHref1, the throttle valve 38 is determined to be substantially stopped or operated in the opening direction (i.e., the deceleration is not instructed).

When the result in S16 is negative, the program proceeds to S18, in which it is determined whether the bit of an after-acceleration third-speed changed flag (explained later; hereinafter called the "third speed flag") which indicates that the gear position has been changed to the third speed after the acceleration was completed, is 0. Since the initial value of this flag is 0, the result in S18 in the first program loop is generally affirmative and the program proceeds to S20.

In S20, the output pulses inputted from the crank angle sensor 102 are counted to detect or calculate the engine speed NE and in S22, a change amount (variation) DNE of the engine speed NE is calculated. The change amount DNE is obtained by subtracting the engine speed NE detected in the present program loop from that detected in the previous program loop.

Next, the program proceeds to S24, in which it is determined whether the bit of an after-acceleration second-speed changed flag (hereinafter called the "second speed flag") is 0. The bit of this flag is set to 1 when the gear position is changed from the first speed to the second speed after the acceleration is completed (explained later), and otherwise, reset to 0.

Since the initial value of the second speed flag is also 0, the result in S24 in the first program loop is generally affirmative and the program proceeds to S26, in which it is determined whether the engine speed NE is equal to or greater than a first predetermined speed NEref1. The first predetermined speed NEref1 will be explained later.

Since the engine speed NE is less than the first predetermined speed NEref1 generally in a program loop immediately after the engine start, the result in S26 is negative and the program proceeds to S28, in which it is determined whether the bit of an acceleration determining flag (explained later; indicated by "acceleration flag" in the drawing) is 0. Since the initial value of this flag is also 0, the result in S28 in the first program loop is generally affirmative and the program proceeds to S30.

In S30, it is determined whether the acceleration (precisely, the rapid acceleration) is instructed to the engine 30 by the operator, i.e., whether the engine 30 is in the operating condition to accelerate the boat 1 (rapidly). This determination is made by checking as to whether the throttle valve 38 is operated in the opening direction rapidly.

Specifically, the change amount DTH of the throttle opening TH detected in S14 is compared with a second predetermined value DTHref2 and when the change amount DTH is equal to or greater than the second predetermined value DTHref2, it is determined that the throttle valve 38 is operated in the opening direction rapidly, i.e., the acceleration is instructed to the engine 30. The second predetermined value DTHref2 is set as a criterion (e.g., 0.5 degree) for determining whether the acceleration is instructed to the engine 30.

When the result in S30 is negative, i.e., it is determined that neither the acceleration nor the deceleration is instructed to the engine 30, in other words, it is immediately after the engine start or in the condition where the boat 1 cruises at constant speed, the program proceeds to S32, in which the first and second solenoid valves 86*a*, 86*b* (indicated by "1ST SOL," "2ND SOL" in the drawing) are both made ON to select the second speed in the transmission 46, and to S34, in which the bit of the acceleration determining flag is reset to 0.

Figure 6:
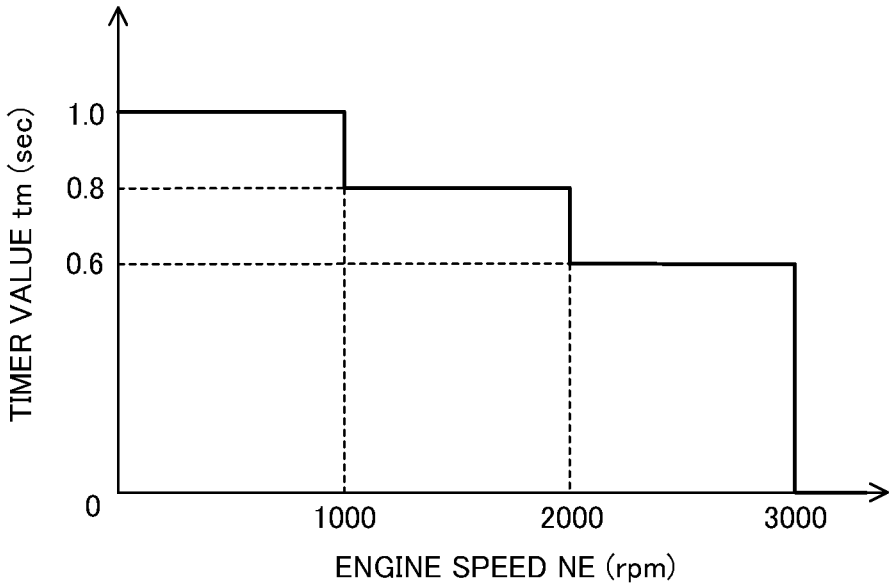
FIG. 6 is a graph showing table characteristics of a timer value with respect to engine speed, which is used in FIG. 5.

On the other hand, when the result in S30 is affirmative, the program proceeds to S36, in which a timer value tm is calculated by retrieving a mapped table, whose characteristics are shown in FIG. 6, using the engine speed NE detected in S20, the calculated timer value tm is set to a timer T (down counter), and then time measurement is started by counting down. The timer T is used to measure elapsed time from when the acceleration is determined to be instructed to the engine 30. The timer value tm represents a time period (predetermined time) from when the acceleration is determined to be instructed until the gear position is changed to the first speed (explained later).

As shown in FIG. 6, the timer value tm (predetermined time) is changed in accordance with the engine speed NE. To be specific, the value tm is set to 1.0 second when the engine speed NE is relatively low (e.g., 0 to 1000 rpm) and is decreased with increasing engine speed NE. More specifically, the value tm is set to 0.8 second when the engine speed NE is 1000 to 2000 rpm, 0.6 second when it is 2000 to 3000 rpm, and 0 second when it is 3000 rpm or more.

In other words, the timer value tm is changed or set to be relatively long when the engine speed NE is low and relatively short when it is high. The characteristics shown in FIG. 6 are experimentally obtained and stored in a memory of the ECU 110 beforehand as table values.

Next, the program proceeds to S38, in which it is determined whether a value of the timer T is 0. When the result in S38 is negative, this determination is repeated, i.e., the second speed of the transmission 46 is maintained, while when the result is affirmative, the program proceeds to S40, in which the first and second solenoid valves 86*a*, 86*b* are both made OFF to change the gear position (shift down the gear) of the transmission 46 from the second speed to the first speed.

Thus, the second speed is maintained immediately after the acceleration is determined to be instructed to the engine 30, whereafter, when the predetermined time (timer value tm) has elapsed (i.e., when the value of the timer T has become 0), the gear position is changed to the first speed. As a result, the output torque of the engine 30 is amplified through the transmission 46 (more precisely, the transmission mechanism 50) which has been shifted down to the first speed, and transmitted to the propeller 42 via the drive shaft 52*a* and propeller shaft 44, thereby improving the acceleration performance.

Then the program proceeds to S42, in which the bit of the acceleration determining flag is set to 1 and the present program is terminated. Specifically, the bit of the acceleration determining flag is set to 1 when the acceleration is determined to be instructed to the engine 30 and the transmission 46 is changed from the second speed to the first speed, and otherwise, reset to 0. Upon setting of the bit of the acceleration determining flag to 1, the result in S28 in the next and subsequent loops becomes negative and the program skips S30, S36 and S38 and proceeds to S40 and 42.

Thus, the transmission 46 is set in the second speed during a period from when the engine 30 is started until the acceleration is determined to be instructed (i.e., during the normal operation) and, whereafter, further until the predetermined time elapses. With this, it becomes possible to ensure the usability of the outboard motor 10 similarly to that of an outboard motor having no transmission.

After the transmission 46 is changed to the first speed in S40, when the engine speed NE is gradually changed and the acceleration through the torque amplification in the first speed is completed (i.e., the acceleration range is saturated), the engine speed NE reaches the first predetermined speed NEref1. Subsequently, in the next program loop, the result in S26 becomes affirmative and the program proceeds to S44 onward. The first predetermined speed NEref1 is set to a relatively high value (e.g., 6000 rpm) as a criterion for determining whether the acceleration in the first speed is completed.

In S44, it is determined whether the engine speed NE is stable, i.e., the engine 30 is stably operated. This determination is made by comparing an absolute value of the change amount DNE of the engine speed NE calculated in S22 with a first prescribed value DNEref1. When the absolute value is less than the first prescribed value DNEref1, the engine speed NE is determined to be stable. The first prescribed value DNEref1 is set as a criterion (e.g., 500 rpm) for determining whether the engine speed NE is stable, i.e., the change amount DNE is relatively small.

When the result in S44 is negative, the program is terminated with the first speed being maintained, and when the result is affirmative, the program proceeds to S46, in which the first and second solenoid valves 86*a*, 86*b* are both made ON to change the transmission 46 (shift up the gear) from the first speed to the second speed. It causes the increase in the rotational speed of the drive shaft 52*a* and that of the propeller shaft 44, so that the boat speed reaches the maximum speed (in a range of the engine performance), thereby improving the speed performance.

After the step of S46, in S48, the bit of the second speed flag is set to 1 and in S50, the bit of the third speed flag is reset to 0.

Upon setting of the bit of the second speed flag to 1 in S48, the result in S24 in the next and subsequent loops becomes negative and the program proceeds to S52. Thus, when the bit of the second speed flag is set to 1, i.e., when the gear position is changed to the second speed after the acceleration in the first speed is completed, the process of S52 onward is conducted.

In S52, it is determined whether the switch 126 outputs the ON signal, i.e., whether the fuel consumption decreasing command for the engine 30 is inputted by the operator. When the result in S52 is affirmative, the program proceeds to S54, in which it is determined whether the engine speed NE is equal to or greater than a second predetermined speed NEref2. The second predetermined speed NEref2 is set to a value (e.g., 5000 rpm) slightly lower than the first predetermined speed NEref1, as a criterion for determining whether it is possible to change the gear position to the third speed (explained later).

When the result in S54 is affirmative, the program proceeds to S56, in which, similarly to S44, it is determined whether the engine speed NE is stable. Specifically, the absolute value of the change amount DNE of the engine speed NE is compared with a second prescribed value DNEref2. When the absolute value is less than the second prescribed value DNEref2, the engine speed NE is determined to be stable, and vice versa. The second prescribed value DNEref2 is set as a criterion (e.g., 500 rpm) for determining whether the change amount DNE is relatively small and the engine speed NE is stable.

When the result in S56 is negative or that in S52 or S54 is negative, the process of S46 to S50 is conducted, whereafter the program is terminated with the second speed being maintained. When the result in S56 is affirmative, the program proceeds to S58, in which the first solenoid valve 86*a* is made ON and the second solenoid valve 86*b* is made OFF to change the transmission 46 (shift up the gear) from the second speed to the third speed. As a result, the engine speed NE is decreased, thereby decreasing the fuel consumption, i.e., improving the fuel efficiency.

Next, the program proceeds to S60, in which the bit of the second speed flag is reset to 0, and to S62, in which the bit of the third speed flag is set to 1. Thus, the third speed flag is set to 1 when the gear position is changed from the second speed to the third speed after the acceleration is completed, and otherwise, reset to 0.

In a program loop after the bit of the third speed flag is set to 1, the result in S18 is negative and the process of S58 to S62 is conducted, whereafter the program is terminated with the third speed being maintained.

When the result in S16 is affirmative, i.e., the deceleration is determined to be instructed to the engine 30, the program proceeds to S64, in which the first and second solenoid valves 86*a*, 86*b* are both made ON to change the transmission 46 to the second speed. Then the program proceeds to S66, S68 and S70, in which all bits of the second speed flag, third speed flag and acceleration determining flag are reset to 0, whereafter the program is terminated.

Under the condition where the second speed is established, when the lever 122 is manipulated by the operator to change the shift position of the transmission 46 to neutral, the result in S10 is affirmative and the program proceeds to S72, in which the first and second solenoid valves 86*a*, 86*b* are both made OFF to change the transmission 46 from the second speed to the first speed.

Figure 7:
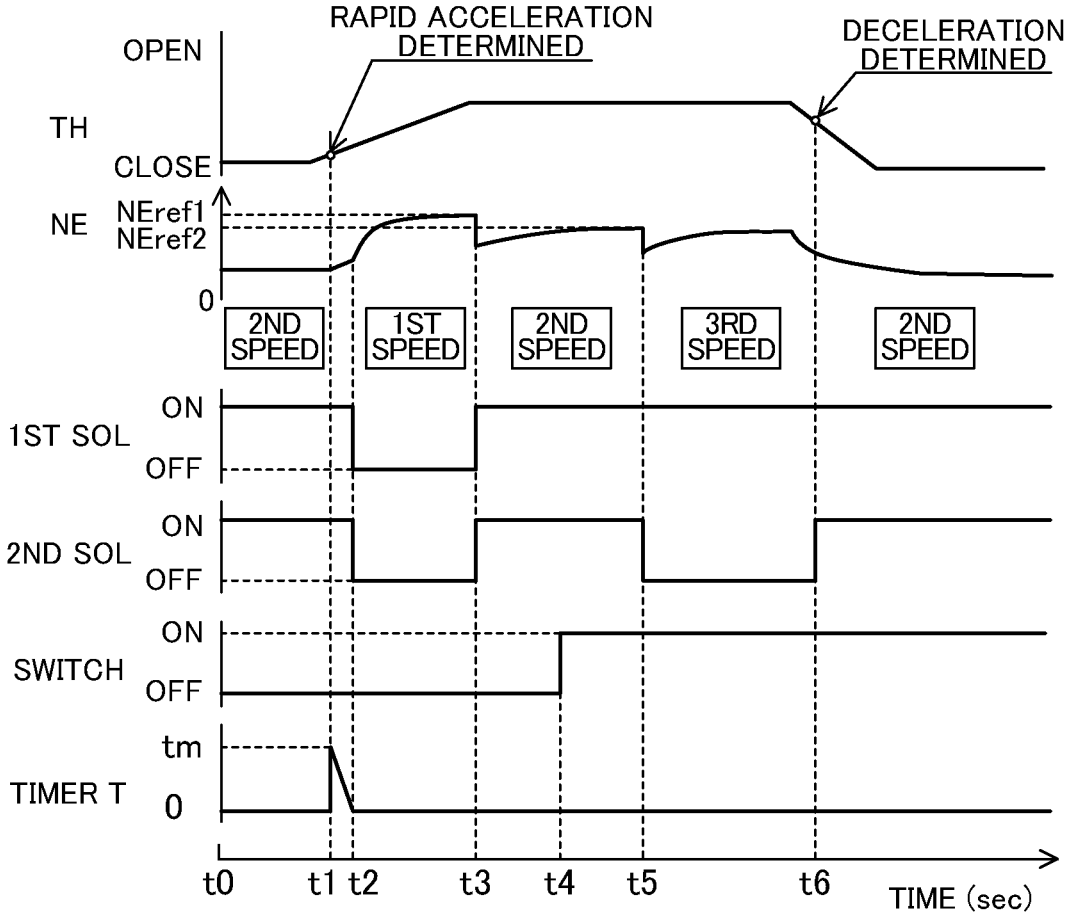
FIG. 7 is a time chart for explaining the operation of the FIG. 5 flowchart.

FIG. 7 is a time chart for explaining the operation of the FIG. 5 flowchart.

As shown in FIG. 7, in the normal operation from the time t0 to t1, the transmission 46 is set in the second speed (S32). Then, when the throttle valve 38 is opened upon the manipulation of the lever 122 by the operator and, at the time t1, it is determined that the acceleration is instructed to the engine 30 (S30), the timer value tm is set to the timer T and the time measurement is started (S36, S38).

The engine speed NE is gradually increased and when, at the time t2, the time T becomes 0, i.e., when the predetermined time (timer value tm) elapses after the acceleration is determined to be instructed (time t1), the gear position is changed from the second speed to the first speed (S40). After that, the engine speed NE is further gradually increased and when, at the time t3, it is determined that the engine speed NE is equal to or greater than the first predetermined speed NEref1 (S26) and the change amount DNE is less than the first prescribed value DNEref1 (S44), the gear position is changed from the first speed to the second speed (S46).

When, at the time t4, the switch 126 is manipulated by the operator to input the fuel consumption decreasing command (S52) and also when, at the time t5, it is determined that the engine speed NE is equal to or greater than the second predetermined speed NEref2 (S54) and the change amount DNE is less than the second prescribed value DNEref2 (S56), the gear position is changed from the second speed to the third speed (S58).

Then, when the throttle valve 38 is closed upon, for example, the manipulation of the lever 122 by the operator to input a regulation command for decreasing the engine speed NE and, at the time t6, the deceleration is determined to be instructed (S16), the gear position is changed from the third speed to the second speed (S64).

As stated above, in the outboard motor control apparatus according to the first embodiment, there are equipped with an acceleration instruction determiner (ECU 110, S30) that determines whether acceleration is instructed to the engine when the second speed is established; a preset-condition determiner (ECU 110, S38) that determines whether a preset condition is met; and a transmission controller (ECU 110, S30, S38, S40) that controls operation of the transmission to change the gear position from the second speed to the first speed when the acceleration is determined to be instructed and the preset condition is met, more specifically, an acceleration instruction determiner (ECU 110, S30) that determines whether acceleration is instructed to the engine when the second speed is established; and a transmission controller (ECU 110, S30, S38, S40) that controls operation of the transmission to change the gear position from the second speed to the first speed when the acceleration is determined to be instructed and a predetermined time (tm) elapses after the acceleration is determined to be instructed.

With this, it becomes possible to change the transmission 46 from the second speed to the first speed at the appropriate time when the engine speed NE is gradually increased upon the instruction to accelerate the engine 30, and also when air bubbles (which are generated immediately after the acceleration is started and weakens the grip force of the propeller 42) decrease after the elapse of the predetermined time so that the grip force is increased. Consequently, the output torque of the engine 30 is amplified through the transmission 46 and transmitted to the propeller 42, whereby the boat speed starts increasing immediately, thereby improving the acceleration performance of immediately after the acceleration is started.

In the apparatus, the acceleration instruction determiner includes a throttle opening change amount detector (throttle opening sensor 96, ECU 110, S14) that detects a change amount of throttle opening (DTH) of the engine, and determines that the acceleration is instructed when the detected change amount of the throttle opening (DTH) is equal to or greater than a predetermined value (DTHref2; S30). With this, it becomes possible to accurately determine that the acceleration is instructed.

In the apparatus, the preset-condition determiner changes the predetermined time (tm) in accordance with speed of the engine (NE; S36), more specifically, the preset-condition determiner changes the predetermined time (tm) to decrease with increasing engine speed (NE; S36). With this, it becomes possible to appropriately set the predetermined time in accordance with the engine speed NE, thereby further improving the acceleration performance of immediately after the acceleration is started.

An outboard motor control apparatus according to a second embodiment of the invention will be explained.

FIG. 8 is a flowchart similar to FIG. 5, but showing an alternative example of transmission control operation by the ECU 110 according to the second embodiment.

The process of S100 to S124 is conducted similarly to S10 to S34 of the FIG. 5 flowchart.

When the result in S120 is affirmative, i.e., the acceleration is determined to be instructed to the engine 30, the program proceeds to S126, in which a slip ratio S indicating the rotating condition of the propeller 42 is detected or calculated. The slip ratio S is calculated based on theoretical velocity Va and actual velocity V of the boat 1, using Equation (1) as follows:

$$\text{Slip ratio } S = (\text{Theoretical velocity } Va\ (\text{Km/h}) - \text{Actual velocity } V\ (\text{Km/h}))/\text{Theoretical velocity } Va\ (\text{Km/h}) \quad \text{Equation (1)}$$

In Equation (1), the actual velocity V is obtained based on the output of the boat speed sensor 130. The theoretical velocity Va is calculated based on the operating condition of the engine 30 and transmission 46 and specification of the propeller 42, as can be seen in Equation (2) as follows:

$$\text{Theoretical velocity } Va\ (\text{Km/h}) = (\text{Engine speed } NE\ (\text{rpm}) \times \text{Propeller pitch (inch)} \times 60 \times 2.54 \times 10^{-5})/(\text{Gear ratio of gear position}) \quad \text{Equation (2)}$$

In Equation (2), the propeller pitch is a value indicating a theoretical distance by which the boat 1 proceeds per one rotation of the propeller 42. The gear ratio of gear position is a gear ratio of the currently-selected gear position in the transmission 46, e.g., is 2.0 in the second speed, as mentioned above. The value of 60 is used for converting the engine speed NE for one minute into that for one hour, and the value of $2.54 \times 10^{-5}$ is used for converting a unit of the propeller pitch from inch to kilometer.

The program proceeds to S128, in which it is determined whether the propeller 42 is under a predetermined rotating condition. This determination is made by comparing the slip ratio S of the propeller 42 detected in S126 with a predetermined slip ratio Sref.

Specifically, when the slip ratio S is equal to or less than the predetermined slip ratio Sref, i.e., when the slip ratio S is relatively small and the grip force of the propeller 42 is relatively large, the propeller 42 is determined to be under the predetermined rotating condition. In contrast, when the slip ratio S is greater than the predetermined slip ratio Sref, i.e., when the slip ratio S is relatively large due to idle rotation of the propeller 42 or the like and the grip force is relatively small, the propeller 42 is determined to be not under the predetermined rotating condition.

The predetermined rotating condition is a condition where the grip force of the propeller 42 is relatively large, and the predetermined slip ratio Sref is set as a criterion (e.g., 0.3) for determining whether the propeller 42 is in such the rotating condition.

When the result in S128 is negative, the remaining steps are skipped, while when the result is affirmative, the program proceeds to S130, in which the first and second solenoid valves 86*a*, 86*b* are both made OFF to change the transmission 46 (shift down the gear) from the second speed to the first speed.

Thus, when it is determined that the acceleration is instructed to the engine 30 and the propeller 42 is under the predetermined rotating condition, the gear position is changed from the second speed to the first speed. As a result, the output torque of the engine 30 is amplified through the transmission 46 which has been shifted down to the first speed, and transmitted to the propeller 42, thereby improving the acceleration performance.

Then the program proceeds to S132, in which the same process as S42 of the FIG. 5 flowchart is conducted.

Thus, the transmission 46 is set in the second speed during a period from when the engine 30 is started until the acceleration is determined to be instructed (during the normal operation) and, whereafter, further until the propeller 42 is determined to be under the predetermined rotating condition. With this, it becomes possible to ensure the usability of the outboard motor 10 similarly to that of an outboard motor having no transmission.

Subsequently, the process of S134 to S162 is conducted similarly to S44 to S72 of the FIG. 5 flowchart.

Figure 9:
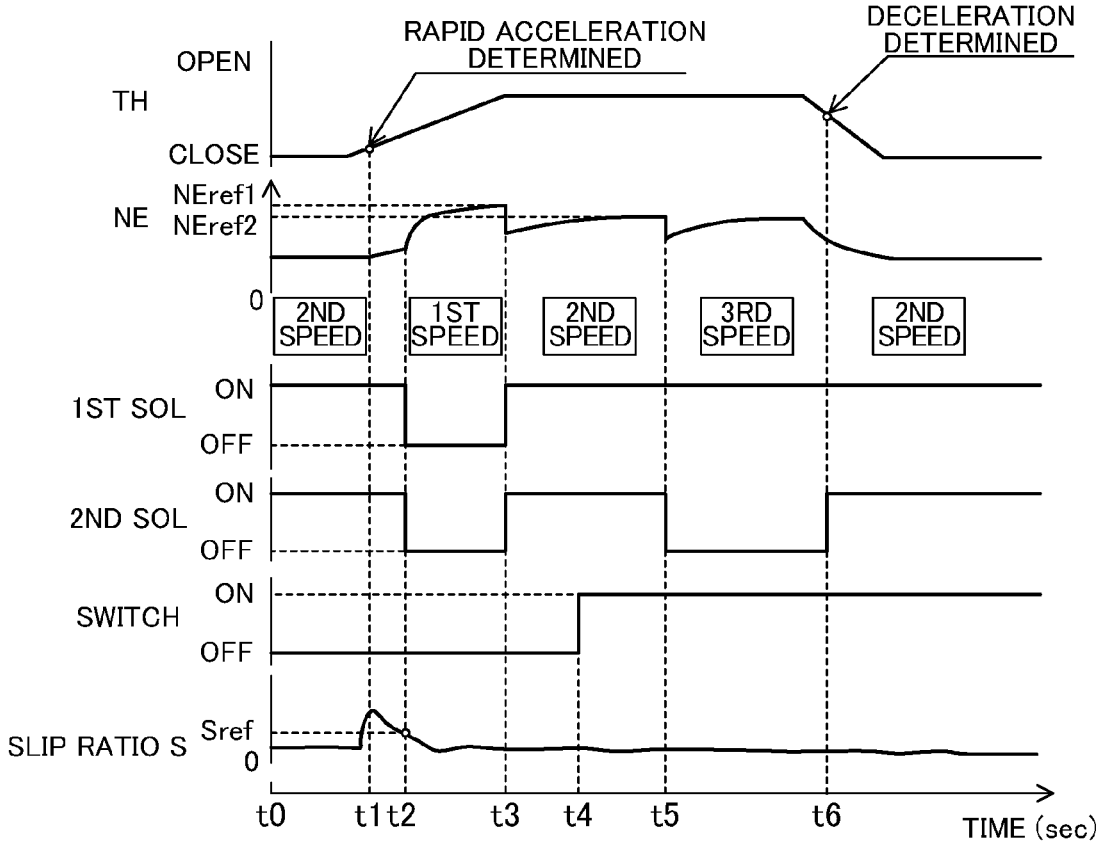
FIG. 9 is a time chart similar to FIG. 7, but for explaining the operation of the FIG. 8 flowchart.

FIG. 9 is a time chart similar to FIG. 7, but explaining the above operation.

As shown in FIG. 9, in the normal operation from the time t0 to t1, the transmission 46 is set in the second speed (S122). Then, upon the manipulation of the lever 122 by the operator, the throttle valve 38 is opened and, at the time t1, the acceleration is determined to be instructed to the engine 30 (S120).

Immediately after the acceleration is started, the propeller 42 tends to be rotated idly because it draws in air bubbles generated around the hull 12, and therefore the grip force thereof becomes relatively small so that the slip ratio S rises. After that, as the air bubbles decrease with time, the decreased grip force is gradually increased (i.e., the slip ratio S is gradually decreased). At the time t2, when it is determined that the slip ratio S is equal to or less than the predetermined slip ratio Sref, i.e., the propeller 42 is under the predetermined rotating condition (S126, S128), the gear position is changed from the second speed to the first speed (S130).

The engine speed NE is gradually increased and when, at the time t3, it is determined that the engine speed NE is equal to or greater than the first predetermined speed NEref1 (S116) and also that the change amount DNE is less than the first prescribed value DNEref1 (S142), the gear position is changed from the first speed to the second speed (S136).

The explanation on the time t4 to t6 is omitted here, as it is the same as in the first embodiment.

As mentioned in the foregoing, the outboard motor control apparatus according to the second embodiment is equipped with a propeller condition determiner (ECU 110, S128) that determines whether the propeller is under a rotating condition, and the transmission controller controls the operation of the transmission to change the gear position from the second speed to the first speed when the acceleration is determined to be instructed and the propeller is determined to be under the rotating condition (S128), more specifically, a slip ratio detector (ECU 110, boat speed sensor 130, S126) that detects a slip ratio (S) of the propeller 42 based on theoretical boat velocity (Va) and actual boat velocity (V), and the transmission controller controls the operation of the transmission to change the gear position from the second speed to the first speed when the acceleration is determined to be instructed and the detected slip ratio (S) is equal to or less than a predetermined slip ratio (Sref; S128).

Specifically, since the predetermined rotating condition is set to a condition where, for instance, air bubbles decrease with time so that the grip force is increased (i.e., where the slip ratio S is decreased to the predetermined slip ratio Sref or less), it becomes possible to appropriately change the transmission 46 from the second speed to the first speed when the grip force is increased. Consequently, the output torque of the engine 30 is amplified through the transmission 46 and transmitted to the propeller 42, whereby the boat speed starts increasing immediately, thereby improving the acceleration performance of immediately after the acceleration is started.

The remaining configuration as well as the effects is the same as that in the first embodiment.

An outboard motor control apparatus according to a third embodiment of the invention will be explained.

Figure 10:
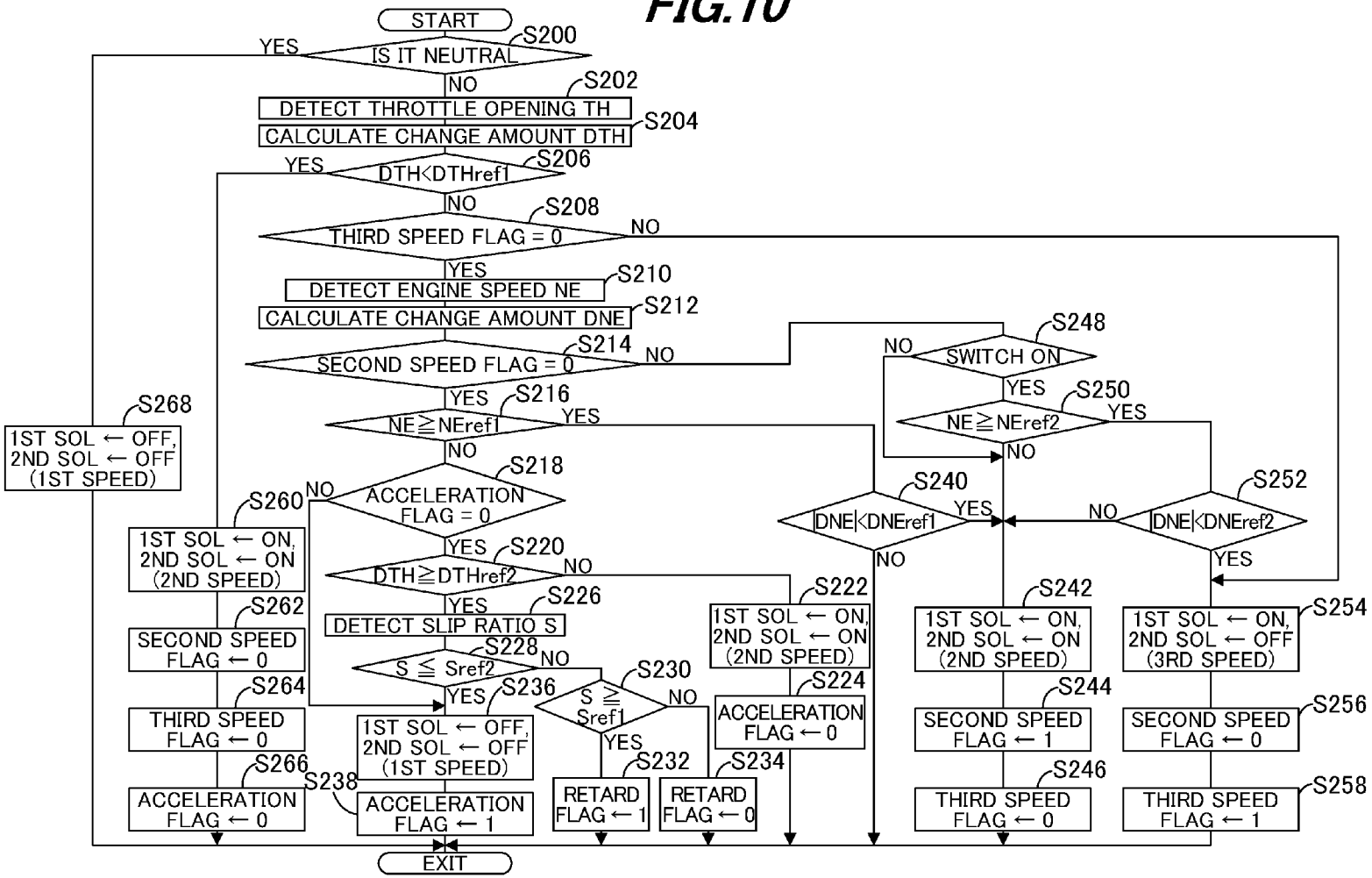
FIG. 10 is a flowchart similar to FIG. 8, but showing transmission control operation and ignition timing control operation by an electronic control unit of an outboard motor control apparatus according to a third embodiment of the invention.

FIG. 10 is a flowchart similar to FIG. 8, but showing transmission control operation and ignition timing control operation by the ECU 110 according to the third embodiment.

The process of S200 to S226 is conducted similarly to S100 to S126 of the FIG. 8 flowchart.

The program proceeds to S228, in which it is determined whether the slip ratio S of the propeller 42 is equal to or less than a second predetermined slip ratio Sref2 set smaller than a first predetermined slip ratio Sref1 (explained later). The second predetermined slip ratio Sref2 is set as a criterion (e.g., 0.3) for determining that, when the slip ratio S is at or below this value, the propeller 42 is under the rotating condition where its grip force is relatively large.

When the result in S228 is negative, the program proceeds to S230, in which it is determined whether the slip ratio S is equal to or greater than the first predetermined slip ratio Sref1. The first predetermined slip ratio Sref1 is set as a criterion (e.g., 0.5) for determining that, when the slip ratio S is at or above this value, the propeller 42 is rotated idly because, for instance, it draws in air bubbles generated around the hull 12 immediately after the acceleration is started, and therefore under the rotating condition where its grip force is relatively small.

When the result in S230 is affirmative, the program proceeds to S232, in which the bit of an ignition timing retard flag (initial value 0; indicated by "retard flag" in the drawing) is set to 1. When the bit of this flag is set to 1, in another program which is not shown, retard control for retarding the ignition timing of the engine 30 is conducted, in other words, the ignition timing calculated based on the output of the crank angle sensor 102 (i.e., the engine speed NE), etc., is retarded by a predetermined angle (e.g., 5 degrees) to decrease the output of the engine 30.

When the bit of the ignition timing retard flag is reset to 0, the retard control is not conducted and normal ignition timing control is conducted. Thus, the process of S232 amounts to the operation for decreasing the engine output.

In response to the reduction or decrease in the engine output, the grip force of the propeller 42 is increased instantaneously and the slip ratio S is decreased to a value below the first predetermined slip ratio Sref1, so that the result in S230 in the next and subsequent loops becomes negative and the program proceeds to S234. In S234, the bit of the ignition timing retard flag is reset to 0 to stop the foregoing retard control and conduct the normal ignition timing control.

When the grip force of the propeller 42 is further increased and the slip ratio S is decreased to a value at or below the second predetermined slip ratio Sref2, the result in S228 is affirmative and the program proceeds to S236, in which the first and second solenoid valves 86*a*, 86*b* are both made OFF to change the transmission 46 (shift down the gear) from the second speed to the first speed.

As a result, the output torque of the engine 30 is amplified through the transmission 46 which has been shifted down to the first speed, and transmitted to the propeller 42, thereby improving the acceleration performance.

Then the program proceeds to S238, in which the same process as S132 of the FIG. 8 flowchart is conducted.

Thus, the transmission 46 is set in the second speed during a period from when the engine 30 is started until the acceleration is determined to be instructed (during the normal operation) and, whereafter, further until the slip ratio S of the propeller 42 is determined to be equal to or less than the second predetermined slip ratio Sref2. With this, it becomes possible to ensure the usability of the outboard motor 10 similarly to that of an outboard motor having no transmission.

Subsequently, the process of S240 to S268 is conducted similarly to S134 to S162 of the FIG. 8 flowchart.

Figure 11:
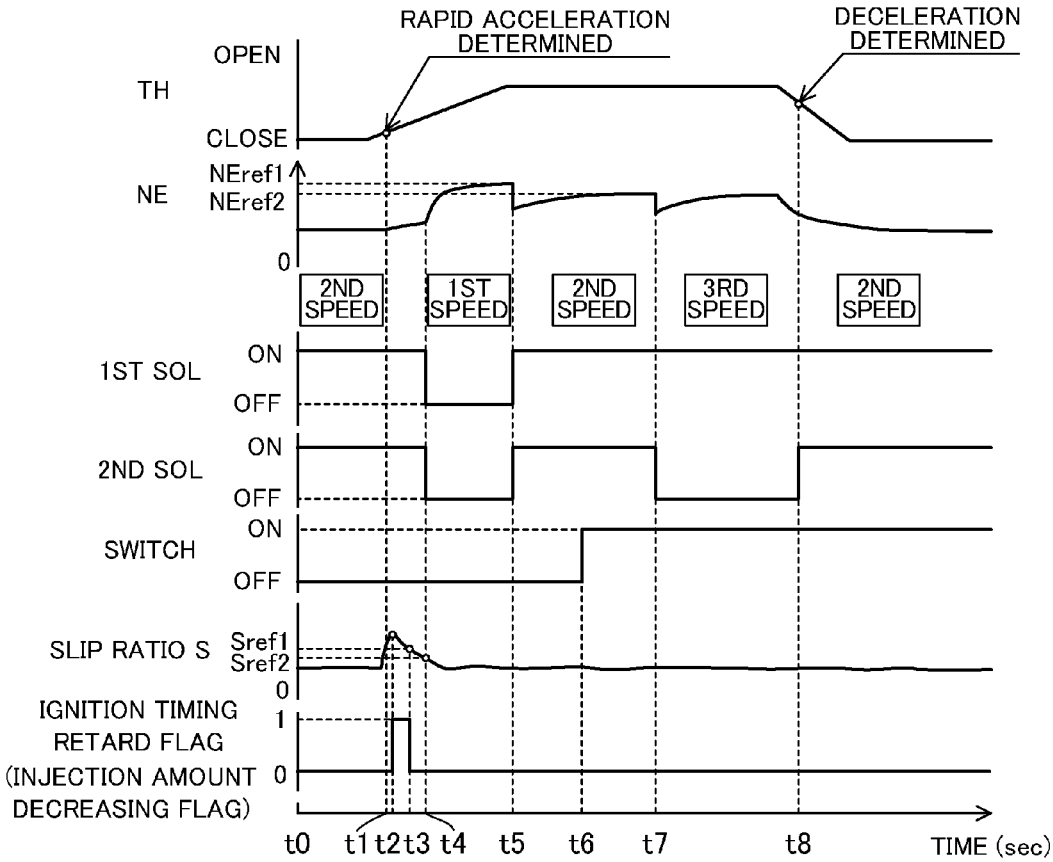
FIG. 11 is a time chart similar to FIG. 9, but for explaining the operation of the FIG. 10 flowchart.

FIG. 11 is a time chart similar to FIG. 9, but explaining the above operation.

The explanation on the time t0 to t1 is omitted here, as it is the same as in the second embodiment.

Immediately after the acceleration is started, the propeller 42 tends to be rotated idly due to interference by air bubbles and therefore the slip ratio S rises as explained. At the time t2, when the slip ratio S is determined to be equal to or greater than the first predetermined slip ratio Sref1 (S230), the bit of the ignition timing retard flag is set to 1 to reduce or decrease the engine output (S232).

The reduction in the engine output causes the increase in the grip force, i.e., the decrease in the slip ratio S. When, at the time t3, the slip ratio S is less than the first predetermined slip ratio Sref1, the bit of the ignition timing retard flag is reset to 0 to stop decreasing the engine output (S234) and when, at the time t4, the slip ratio S is decreased to a value at or below the second predetermined slip ratio Sref2 (S228), the gear position is changed from the second speed to the first speed (S236).

The explanation on the time t5 to t8 is omitted here, as it is the same as that on the time t2 to t6 in the second embodiment.

As mentioned in the foregoing, the outboard control apparatus according to the third embodiment is equipped with a slip ratio detector (ECU 110, boat speed sensor 130, S226) that detects a slip ratio (S) of the propeller 42 based on theoretical boat velocity (Va) and actual boat velocity (V), and an engine output reducer (ECU 110, S230, S232) that reduces an output of the engine when the acceleration is determined to be instructed and the slip ratio (S) is equal to or greater than a first predetermined slip ratio (Sref1), and the transmission controller controls the operation of the transmission to change the gear position from the second speed to the first speed when the slip ratio (S) is decreased to a value at or below a second predetermined slip ratio (Sref2) set smaller than the first predetermined slip ratio (Sref1) after the output of the engine is reduced by the engine output reducer (S228, S236).

Specifically, when the acceleration is determined to be instructed and also when the slip ratio S of the propeller 42 is equal to or greater than the first predetermined slip ratio Sref1 (i.e., the slip ratio S is relatively large so that the grip force is decreased), the engine output is reduced or decreased temporarily so that the grip force instantaneously rises. After that, when the slip ratio S is decreased to a value at or below the second predetermined slip ratio Sref2, the gear position is changed from the second speed to the first speed.

In other words, the gear position can be changed at the appropriate time when the slip ratio S is relatively small so that the grip force is increased. With this, the output torque of the engine 30 is amplified through the transmission 46 and transmitted to the propeller 42, whereby the boat speed starts increasing immediately, thereby improving the acceleration performance of immediately after the acceleration is started.

In the apparatus, the engine output reducer reduces the output of the engine by controlling a ignition timing (S232), more specifically, the engine output reducer reduces the output of the engine by retarding the ignition timing (S232).

With this, when the acceleration is determined to be instructed and the slip ratio S is equal to or greater than the first predetermined slip ratio Sref1, the ignition timing can be retarded, thereby reliably decreasing the engine output.

The remaining configuration is the same as that in the foregoing embodiments.

An outboard motor control apparatus according to a fourth embodiment of the invention will be explained.

The explanation will be made with focus on points of difference from the third embodiment. In the fourth embodiment, instead of the ignition timing, the fuel injection amount of the engine 30 is used to reduce or decrease the engine output.

Figure 12:
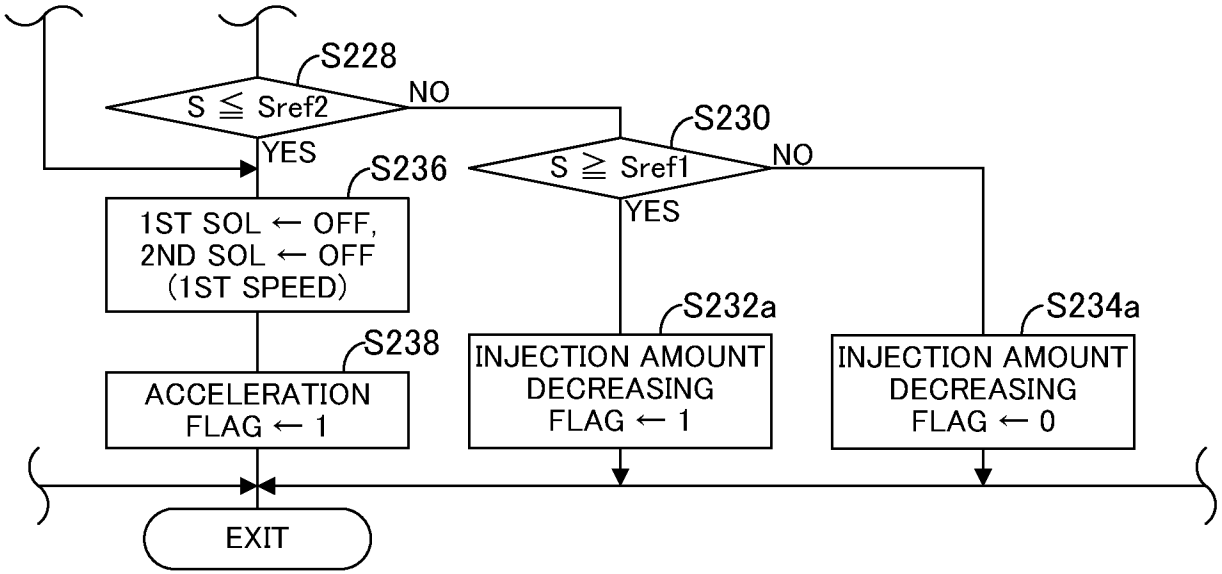
FIG. 12 is a flowchart showing transmission control operation and fuel injection amount control operation by an electronic control unit of an outboard motor control apparatus according to a fourth embodiment of the invention, with focus on points of difference from the FIG. 10 flowchart.

FIG. 12 is a flowchart partially showing transmission control operation and fuel injection amount control operation by the ECU 110 according to the fourth embodiment, with focus on points of difference from the FIG. 10 flowchart. The same step numbers as in FIG. 10 are given to corresponding steps.

Explaining the FIG. 12 flowchart, the steps of S200 to S230 are conducted as in the third embodiment. When the result in S230 is affirmative, the program proceeds to S232*a*, in which the bit of an injection amount decreasing flag (initial value 0) is set to 1. When the bit of this flag is set to 1, in another program which is not shown, control for decreasing a fuel injection amount to be supplied to the engine 30 is conducted, specifically, the fuel injection amount calculated based on the output of the crank angle sensor 102 (i.e., the engine speed NE), etc., is decreased by a predetermined amount to reduce or decrease the output of the engine 30. In other words, the process of S232*a* amounts to the operation to reduce the engine output, similarly to S232 in the third embodiment.

When the result in S230 is negative, the program proceeds to S234*a*, in which the bit of the injection amount decreasing flag is reset to 0, i.e., this control is stopped or not conducted and normal fuel injection control is conducted.

Note that, in the fourth embodiment, the timing to set the injection amount decreasing flag to 1 or 0 is the same as in the case of the ignition timing retard flag in FIG. 11. The remaining configuration and the effects is the same as that in the third embodiments.

As stated above, the first to fourth embodiments are configured to have an apparatus and a method for controlling operation of an outboard motor (10) adapted to be mounted on a stern of a boat (12) and having an internal combustion engine (30) to power a propeller (42) through a propeller shaft (44), and a transmission (46) installed at a location between the engine and the propeller shaft, the transmission being selectively changeable in gear position to establish speeds including at least a first speed and a second speed and transmitting power of the engine to the propeller with a gear ratio determined by established speed, comprising: an acceleration instruction determiner (ECU 110, S30, S120, S220) that determines whether acceleration is instructed to the engine when the second speed is established; a preset-condition determiner (ECU 110, S38, S128, S228) that determines whether a preset condition is met; and a transmission controller (ECU 110, S30, S38, S40, S120, S128, S130, S220, S228, S236) that controls operation of the transmission to change the gear position from the second speed to the first speed when the acceleration is determined to be instructed and the preset condition is met.

With this, it becomes possible to appropriately control the operation of the transmission 46 at the acceleration, thereby improving the acceleration performance of immediately after the acceleration is started.

In the apparatus and method of the first embodiment, the preset-condition determiner determines that the preset condition is met when a predetermined time (tm) elapses after the acceleration is determined to be instructed (S36, S38).

With this, it becomes possible to change the transmission 46 from the second speed to the first speed at the appropriate time when the engine speed NE is gradually increased upon the instruction to accelerate the engine 30, and also when air bubbles (which are generated immediately after the acceleration is started and weakens the grip force of the propeller 42) decrease after the elapse of the predetermined time so that the grip force is increased. Consequently, the output torque of the engine 30 is amplified through the transmission 46 and transmitted to the propeller 42, whereby the boat speed starts increasing immediately, thereby improving the acceleration performance of immediately after the acceleration is started.

In the apparatus and method of the first to fourth embodiments, the acceleration instruction determiner includes: a throttle opening change amount detector (throttle opening sensor 96, ECU 110, S14, S104 S204) that detects a change amount of throttle opening (DTH) of the engine; and determines that the acceleration is instructed when the detected change amount of the throttle opening (DTH) is equal to or greater than a predetermined value (DTHref2; S30, S120, S220).

With this, in addition to the above effects, it becomes possible to accurately determine that the acceleration is instructed.

In the apparatus and method of the first embodiment, the preset-condition determiner changes the predetermined time (tm) in accordance with speed of the engine (NE; S36).

With this, it becomes possible to appropriately set the predetermined time (from when the acceleration is instructed until the gear position is changed to the first speed) in accordance with the engine speed NE, thereby further improving the acceleration performance of immediately after the acceleration is started.

In the apparatus and method, the preset-condition determiner changes the predetermined time (tm) to decrease with increasing engine speed (NE; S36).

With this, in addition to the above effects, it becomes possible to set the predetermined time more appropriately in accordance with the engine speed NE, thereby further improving the acceleration performance of immediately after the acceleration is started.

In the apparatus and method of the second to fourth embodiments, the preset-condition determiner includes: a propeller condition determiner (ECU 110, S128, S228) that determines whether the propeller is under (or in) a rotating condition; and determines that the preset condition is met when the propeller is determined to be under (or in) the rotating condition (S128, S228).

Specifically, since the predetermined rotating condition is set to a condition where, for instance, air bubbles (which are generated immediately after the acceleration is started and weakens the grip force of the propeller 42) decrease with time so that the grip force is increased (i.e., where the slip ratio S is decreased to the predetermined slip ratio Sref, Sref2 or less), it becomes possible to appropriately change the transmission 46 from the second speed to the first speed when the grip force is increased. Consequently, the output torque of the engine 30 is amplified through the transmission 46 and transmitted to the propeller 42, whereby the boat speed starts increasing immediately, thereby improving the acceleration performance of immediately after the acceleration is started.

In the apparatus and method, the propeller condition determiner includes: a slip ratio detector (ECU 110, boat speed sensor 130, S126, S226) that detects a slip ratio (S) of the propeller (42) based on theoretical boat velocity (Va) and actual boat velocity (V); and determines that the propeller is under the predetermined rotating condition when the detected slip ratio (S) is equal to or less than a predetermined slip ratio (Sref, Sref2; S128, S228).

With this, it becomes possible to accurately determine that the propeller 42 is under the predetermined rotating condition (where its grip force is increased), and since the gear position is changed from the second speed to the first speed at that time, the acceleration performance of immediately after the acceleration is started can be further improved.

In the apparatus and method of the third and fourth embodiments further include: a slip ratio detector (ECU 110, boat speed sensor 130, S226) that detects a slip ratio (S) of the propeller (42) based on theoretical boat velocity (Va) and actual boat velocity (V); and an engine output reducer (ECU 110, S230, S232, S232*a*) that reduces an output of the engine when the acceleration is determined to be instructed and the slip ratio (S) is equal to or greater than a first predetermined slip ratio (Sref1); and the preset-condition determiner determines that the preset condition is met when the slip ratio (S) is decreased to a value at or below a second predetermined slip ratio (Sref2) set smaller than the first predetermined slip ratio (Sref1) after the output of the engine is reduced by the engine output reducer (S228).

Specifically, when the acceleration is determined to be instructed and also when the slip ratio S of the propeller 42 is equal to or greater than the first predetermined slip ratio Sref1 (i.e., the slip ratio S is relatively large so that the grip force is decreased), the engine output is reduced or decreased temporarily so that the grip force instantaneously rises. After that, when the slip ratio S is decreased to a value at or below the second predetermined slip ratio Sref2, the gear position is changed from the second speed to the first speed.

In other words, the gear position can be changed at the appropriate time when the slip ratio S is relatively small so that the grip force is increased. With this, the output torque of the engine 30 is amplified through the transmission 46 and transmitted to the propeller 42, whereby the boat speed starts increasing immediately, thereby improving the acceleration performance of immediately after the acceleration is started.

In the apparatus and method, the engine output reducer reduces the output of the engine by controlling at least one of ignition timing and a fuel injection amount (S232, S232*a*).

With this, when the acceleration is determined to be instructed and the slip ratio S is equal to or greater than the first predetermined slip ratio Sref1, the ignition timing can be retarded or the fuel injection amount can be decreased, thereby reliably decreasing the engine output.

In the apparatus and method, the engine output reducer reduces the output of the engine by retarding the ignition timing and decreasing the fuel injection amount (S232, S232*a*).

With this, in addition to the above effects, it becomes possible to reduce the engine output further reliably.

It should be noted that, in the third and fourth embodiments, although the ignition timing is retarded or the fuel injection amount is decreased, the both operation can be conducted together and further, the ignition cut-off and/or fuel cut-off can be added thereto to reduce the engine output. In that sense, it is described in Claim 9 as "the engine output reducer reduces the output of the engine by controlling at least one of ignition timing and a fuel injection amount."

It should also be noted that, in the second to fourth embodiments, the actual velocity V of the boat 1 can be detected by, in place of the boat speed sensor 130, a GPS (Global Positioning System) for instance.

It should also be noted that, although the first and second predetermined values DTHref1, DTHref2, first and second predetermined speeds NEref1, NEref2, first and second prescribed values DNEref1, DNEref2, predetermined slip ratio Sref, first and second predetermined slip ratios Sref1, Sref2, displacement of the engine 30 and other values are indicated with specific values in the foregoing, they are only examples and not limited thereto.

Japanese Patent Application Nos. 2009-285802, 2009-285803 and 2009-285805, all filed on Dec. 16, 2009 are incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor adapted to be mounted on a stern of a boat and having an internal combustion engine to power a propeller through a propeller shaft, and a transmission installed at a location between the engine and the propeller shaft, the transmission being selectively changeable in gear position to establish speeds including at least a first speed and a second speed and transmitting power of the engine to the propeller with a gear ratio determined by established speed, comprising:

an acceleration instruction determiner that determines whether acceleration is instructed to the engine when the second speed is established;

a preset-condition determiner that determines whether a preset condition is met; and a transmission controller that controls operation of the transmission to change the gear position from the second speed to the first speed at a time the acceleration is determined to be instructed and the preset condition is met, wherein the preset-condition determiner determines that the preset condition is met after a predetermined time, which begins at the time the acceleration is determined to be instructed, elapses, wherein the preset-condition determiner changes the predetermined time in accordance with speed of the engine.

2. The apparatus according to claim 1, wherein the acceleration instruction determiner includes:

a throttle opening change amount detector that detects a change amount of throttle opening of the engine; and determines that the acceleration is instructed when the detected change amount of the throttle opening is equal to or greater than a predetermined value.

3. The apparatus according to claim 1, wherein the preset-condition determiner changes the predetermined time to decrease with increasing engine speed.

4. The apparatus according to claim 1, wherein the preset-condition determiner includes:

a propeller condition determiner that determines whether the propeller is under a rotating condition; and determines that the preset condition is met when the propeller is determined to be under the rotating condition.

5. The apparatus according to claim 4, wherein the propeller condition determiner includes:

a slip ratio detector that detects a slip ratio of the propeller based on theoretical boat velocity and actual boat velocity; and determines that the propeller is under the predetermined rotating condition when the detected slip ratio is equal to or less than a predetermined slip ratio.

6. The apparatus according to claim 1, further including:

a slip ratio detector that detects a slip ratio of the propeller based on theoretical boat velocity and actual boat velocity; and an engine output reducer that reduces an output of the engine when the acceleration is determined to be instructed and the slip ratio is equal to or greater than a first predetermined slip ratio; and the preset-condition determiner determines that the preset condition is met when the slip ratio is decreased to a value at or below a second predetermined slip ratio set smaller than the first predetermined slip ratio after the output of the engine is reduced by the engine output reducer.

7. The apparatus according to claim 6, wherein the engine output reducer reduces the output of the engine by controlling at least one of ignition timing and a fuel injection amount.

8. The apparatus according to claim 7, wherein the engine output reducer reduces the output of the engine by retarding the ignition timing and decreasing the fuel injection amount.

9. A method for controlling operation of an outboard motor adapted to be mounted on a stern of a boat and having an internal combustion engine to power a propeller through a propeller shaft, and a transmission installed at a location between the engine and the propeller shaft, the transmission being selectively changeable in gear position to establish speeds including at least a first speed and a second speed and transmitting power of the engine to the propeller with a gear ratio determined by established speed, comprising the steps of:

determining whether acceleration is instructed to the engine when the second speed is established;

initializing a predetermined time period at a time of the determination that acceleration is instructed;

waiting for the elapse of the predetermined time period;

determining whether a preset condition is met after the predetermined time period elapses; and controlling operation of the transmission to change the gear position from the second speed to the first speed subsequent to the determination that acceleration is instructed and the preset condition is met, wherein the step of preset-condition determining changes the predetermined time in accordance with speed of the engine.

10. The method according to claim 9, wherein the step of acceleration instruction determining includes the step of:

detecting a change amount of throttle opening of the engine; and determines that the acceleration is instructed when the detected change amount of the throttle opening is equal to or greater than a predetermined value.

11. The method according to claim 9, wherein the step of preset-condition determining changes the predetermined time to decrease with increasing engine speed.

12. The method according to claim 9, wherein the step of preset-condition determining includes the step of:

determining whether the propeller is under a rotating condition; and determines that the preset condition is met when the propeller is determined to be under the rotating condition.

13. The method according to claim 12, wherein the step of rotating condition determining includes the step of:

detecting a slip ratio of the propeller based on theoretical boat velocity and actual boat velocity; and determines that the propeller is under the predetermined rotating condition when the detected slip ratio is equal to or less than a predetermined slip ratio.

14. The method according to claim 9, further including the steps of:

detecting a slip ratio of the propeller based on theoretical boat velocity and actual boat velocity; and reducing an output of the engine when the acceleration is determined to be instructed and the slip ratio is equal to or greater than a first predetermined slip ratio; and the step of preset-condition determining determines that the preset condition is met when the slip ratio is decreased to a value at or below a second predetermined slip ratio set smaller than the first predetermined slip ratio after the output of the engine is reduced by the step of engine output reducing.

15. The method according to claim 14, wherein the step of engine output reducing reduces the output of the engine by controlling at least one of ignition timing and a fuel injection amount.

16. The method according to claim 15, wherein the step of engine output reducing reduces the output of the engine by retarding the ignition timing and decreasing the fuel injection amount.

* * * * *